US005209179A

United States Patent [19]

Herbert et al.

[11] Patent Number: 5,209,179

[45] Date of Patent: May 11, 1993

[54] LIQUID COATING APPARATUS FOR USE IN CONJUNCTION WITH PRINTING PRESSES WHERE ACCESS OF THE COATING APPARATUS TO THE PRESS CYLINDERS IS RESTRICTED

[75] Inventors: John C. Herbert, Huntington Bay, N.Y.; Frank A. Andaloro, Pawcatuck, Conn.

[73] Assignee: Herbert Products, Inc., Westbury, N.Y.

[21] Appl. No.: 709,750

[22] Filed: Jun. 4, 1991

[51] Int. Cl.[5] ..... B05C 1/02

[52] U.S. Cl. ..... 118/46; 118/249; 118/257; 118/231; 101/DIG. 48

[58] Field of Search ..... 118/46, 211, 219, 221, 118/231, 249, 257; 101/DIG. 33, DIG. 48

[56] References Cited

U.S. PATENT DOCUMENTS

| | | | |
|---|---|---|---|
| 3,920,431 | 11/1975 | Reese | 118/257 |
| 3,989,569 | 11/1976 | Newman | 118/257 |
| 4,169,413 | 10/1979 | Aaron et al. . | |
| 4,214,525 | 7/1980 | Aaron et al. . | |
| 4,515,103 | 5/1985 | Greig | 118/257 |
| 4,538,516 | 9/1985 | Aaron | 101/DIG. 48 |
| 4,685,414 | 8/1987 | DiRico . | |
| 4,817,525 | 4/1989 | Yagi | 101/DIG. 48 |
| 4,825,804 | 5/1989 | DiRico et al. . | |
| 4,848,265 | 7/1989 | Komori . | |
| 4,934,305 | 6/1990 | Koehler et al. . | |

FOREIGN PATENT DOCUMENTS

| | | | |
|---|---|---|---|
| 6971 | of 1912 | United Kingdom | 118/249 |

*Primary Examiner*—W. Gary Jones
*Assistant Examiner*—Todd J. Burns
*Attorney, Agent, or Firm*—Hoffmann & Baron

[57] ABSTRACT

A liquid coating apparatus capable of applying a liquid coating fluid to a workpiece traveling over a press cylinder rotatably mounted in a printing press is provided. The coating apparatus includes an applicator means which communicates with the press cylinder to form a nip site when the coating apparatus is in a operative position. The applicator means transfers the liquid coating fluid from the coating apparatus to a workpiece that has been caused to travel through the nip site. The applicator means includes an endless coating plate belt driveably mounted upon two support rollers, thereby affording communication of the endless coating plate belt with a press cylinder which has limited access to its surface.

16 Claims, 4 Drawing Sheets

LIQUID COATING APPARATUS FOR USE IN CONJUNCTION WITH PRINTING PRESSES WHERE ACCESS OF THE COATING APPARATUS TO THE PRESS CYLINDERS IS RESTRICTED

BACKGROUND OF THE INVENTION

1. Field of the Invention

The present invention relates to the printing industry and in particular to coating apparatus used in conjunction with printing presses for the application of liquid coating fluid to the surface of a workpiece. In particular, the present invention relates to coating apparatus which apply a liquid coating fluid to a workpiece while the workpiece travels over a press cylinder rotating in a printing press. More particularly, the present invention relates to coating apparatus for applying a liquid coating fluid to a workpiece on a press cylinder where access to the surface of the cylinder is restricted due to the orientation of adjacent cylinders operating in the printing press.

2. Description of the Prior Art

In many situations in the printing industry, it is desirable to apply a liquid coating fluid to the surface of a workpiece as it travels through a printing press. In order to achieve this objective, it is necessary to position a coating apparatus in sufficient proximity to the printing press so that the applicator means of the coating apparatus can contact the workpiece and apply the coating fluid as the workpiece moves over one of the press cylinders. Once the applicator means comes in contact with the press cylinder, a "nip" is formed through which the workpiece can travel.

In the printing industry, there are several types of printing presses having press cylinders which are oriented within the press frame in such a manner that access to their surface is limited. Consequently, problems have arisen when artisans have attempted to position a coating apparatus within sufficient proximity to the printing press so that the applicator means of the coating apparatus can form a "nip" with a particular press cylinder in the press.

These problems are mostly due to spacial constraints imposed by other press cylinders which are adjacent to the particular press cylinder sought to be contacted. For example, in one commercially available printing press (manufactured by the Komori Corporation, Tokyo, Japan), the impression cylinder is positioned between a blanket cylinder and a delivery or transfer cylinder in a configuration that severely restricts access to the surface of the impression cylinder. Consequently, existing coating assemblies cannot be used with such presses where contact with the impression cylinder is desired since the diameter of the applicator roller of these assemblies is too large to clear the space between the blanket cylinder and the delivery or transfer cylinder.

It is therefore an object of the present invention to provide for a coating apparatus which can be used in conjunction with a printing press to apply a liquid coating fluid to a workpiece traveling on a press cylinder having restricted access to its surface.

SUMMARY OF THE INVENTION

The present invention is a liquid coating apparatus operable in conjunction with either a sheet-fed or a web-fed printing press and is capable of applying a liquid coating fluid to a workpiece while the workpiece travels over the surface of a press cylinder rotating within the press. The present invention is especially advantageous when attempting to apply coating fluid to a workpiece traveling upon a press cylinder having restricted access to its surface.

The coating apparatus of the present invention includes a driveable support means capable of supporting an endless coating plate belt which functions to transfer liquid coating fluid from the coating apparatus to the workpiece. The coating plate belt is both supported and driven by the driveable support means. The coating apparatus also includes means for driving the driveable support means such that the coating plate belt is caused to be driven about the support means. A supply means is included to supply the liquid coating fluid to the belt while a metering means is employed to meter the supply of liquid coating fluid being supplied to the belt.

For a better understanding of the present invention, together with other and further objects, reference is made to the following description, taken together with the accompanying drawings and its scope will be pointed out in the appended claims.

DETAILED DESCRIPTION OF THE PREFERRED EMBODIMENT OF THE INVENTION

Figure 1:
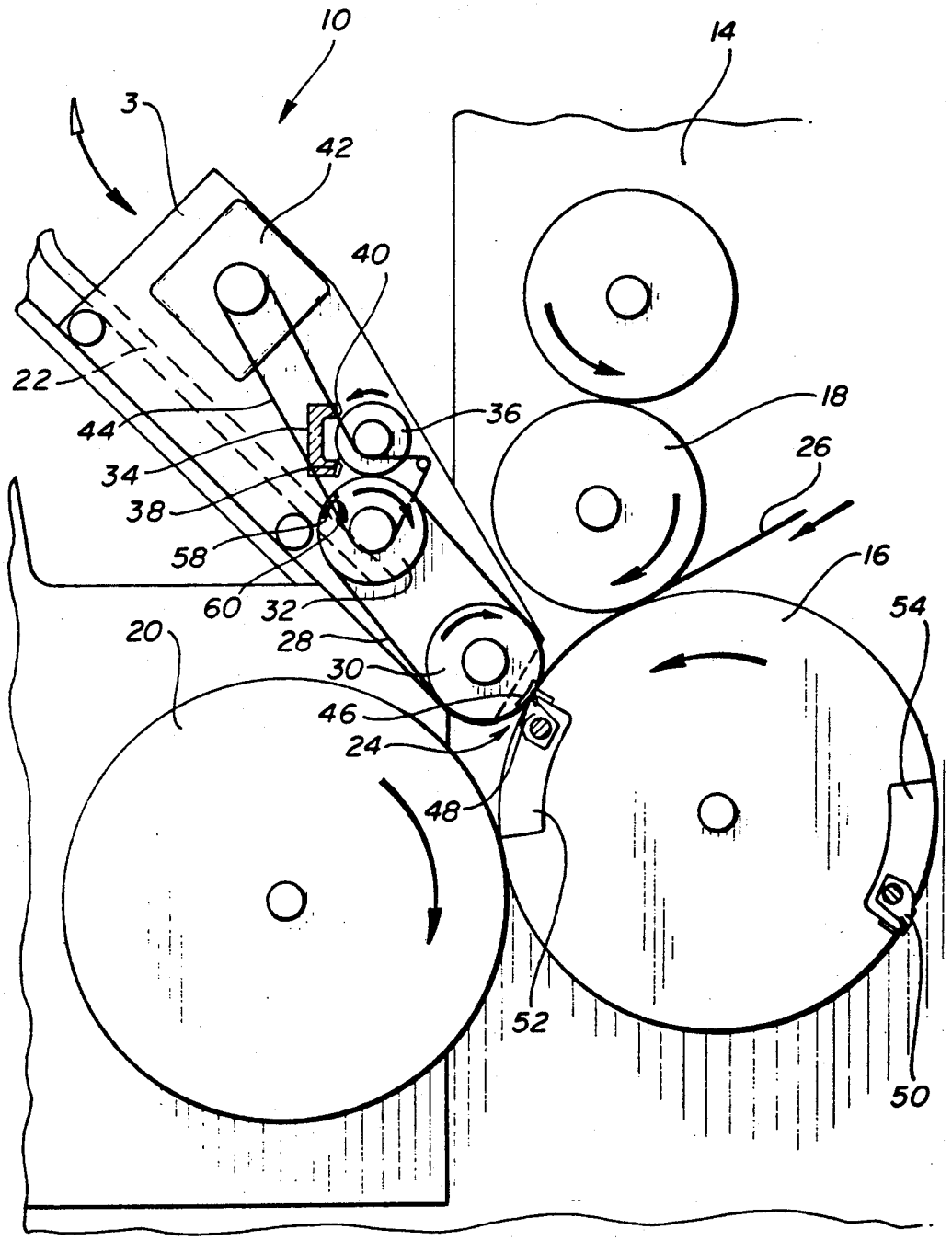
FIG. 1 is a side elevational view of the coating apparatus of the present invention shown in communication with a sheet-fed printing press.

Referring to FIGS. 1–4, the preferred embodiment of a coating apparatus 10 of the present invention is provided. Referring to FIG. 1, the coating apparatus 10 is shown positioned adjacent to a printing press 14. The printing press 14 includes a printing press cylinder 16 which is typically either a blanket or an impression cylinder. Press cylinder 16 has limited access to its surface due to adjacent press cylinders 18 and 20.

Retraction means 22 is provided for moving the coating apparatus into and out of an adjoining relationship with press cylinder 22 at nip site 24. In the operative position, the coating apparatus forms a "nip" with press cylinder 16 through which a workpiece 26 may pass.

Coating apparatus 10 includes an endless coating plate belt 28 which is supported by and trained about a first roller 30 and a second roller 32, both mounted for rotation within coating apparatus frame 33.

The coating belt 28 delivers liquid coating fluid to workpiece 26 as the workpiece travels through nip site 24 mounted about cylinder 16. Coating fountain 34 supplies liquid coating fluid to anilox roller 36 which, in turn, transfers the coating fluid from the fountain to coating belt 28. Doctor blades 38 and 40 are coupled to coating fountain 34 to meter the supply of coating fluid transferred to coating belt 28 via anilox roller 36. The liquid coating supply means can be of any suitable type known in the art. Additionally, other methods known in the art for transferring and metering the coating supply to be received by coating belt 28 could alternatively be employed. The combination of an anilox roller and a doctor blade is merely exemplary of one such approach.

As previously mentioned, a first roller 30 and a second roller 32 provide support for coating plate belt 28. Roller 30 is referred to as a pressure roller since it provides the coating plate belt 28 with support at nip site 24, thereby affording sufficient "back pressure" against workpiece 26 as it moves through the nip. Roller 32 is referred to as a transfer roller since it provides the coating belt with support at the point where the coating belt receives coating fluid that has been transferred by anilox roller 36.

Coating plate belt 28 is trained around the pressure and transfer rollers for movement about the rollers. At least one of the rollers is driveably coupled to a motor or some other drive means. In the preferred embodiment of the present invention, transfer roller 32 is driveably coupled to motor 42 by way of drive train belt 44 enabling transfer roller 32 to undergo rotation upon activation of motor 42. Coating belt 28 is driveably coupled to transfer roller 32 such that rotation of the roller drives the coating belt about both pressure roller 30 and transfer roller 32.

Figure 4:
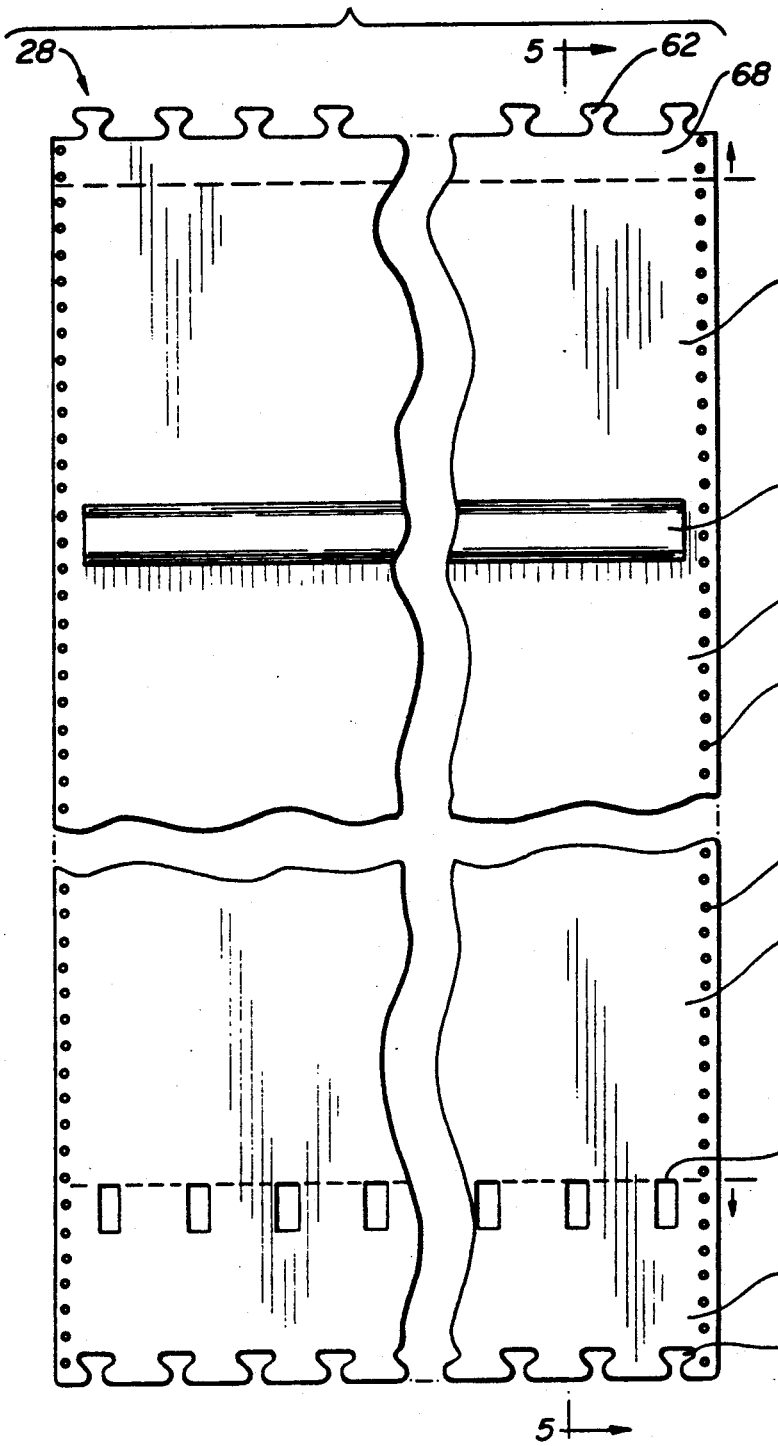
FIG. 4 is a plan view of the coating plate belt of the present invention shown from the backside of the belt.
Figure 5:
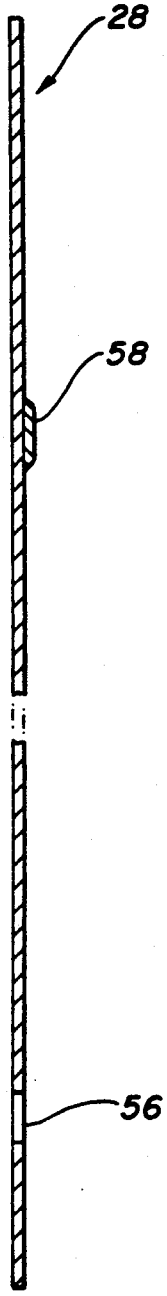
FIG. 5 is a side elevational view of the coating plate belt of FIG. 4.

In the preferred embodiment of the present invention, pressure roller 30 is not coupled to drive train belt 44, but rather rotates via a drive coupling (not shown) with coating plate belt 28. This drive coupling can be of any suitable type known in the art. For example, FIG. 4 shows coating plate belt 28 having track holes 45. These track holes communicate with sprocket assemblies (not shown) on rollers 30 and 32.

Referring to FIGS. 1–4, transfer roller 32 undergoes rotation via drive train belt 44. A sprocket assembly (not shown) coupled to transfer roller 32 rotates engaging track holes 45 on coating plate belt 28, thereby imparting movement to the coating belt. Consequently, coating plate belt 28 undergoes movement and imparts rotation to pressure roller 30 upon communication of track holes 45 with a sprocket assembly (not shown) coupled to roller 30. Alternatively, drive train belt 44 can be driveably coupled to pressure roller 30, leaving transfer roller 32 to undergo rotation via movement of coating belt 28.

Another drive train configuration (not shown) can also be employed utilizing an auxiliary drive coupling between transfer roller 32 and pressure roller 30. In this configuration, drive train belt 44 is operatively coupled to one of the rollers at one side while the auxiliary drive coupling is coupled to the other side. The auxiliary drive coupling is also coupled to the other roller, thereby imparting rotation to the other roller and alleviating drive stress on the coating plate belt 28.

In the preferred embodiment of the present invention, the rollers of the coating apparatus are driven by an independent drive means, such as motor 42. Alternatively, the rollers of the coating apparatus could be driven by a positive coupling to the printing press drive train, thereby avoiding the need for an independent motor assembly.

Although the present invention is capable of applying liquid coating fluid to a workpiece traveling over a press cylinder in either a web-fed or an individual sheet-fed press, the preferred embodiment shown in FIGS. 1–4 includes structure for operation in conjunction with the latter.

Figure 2:
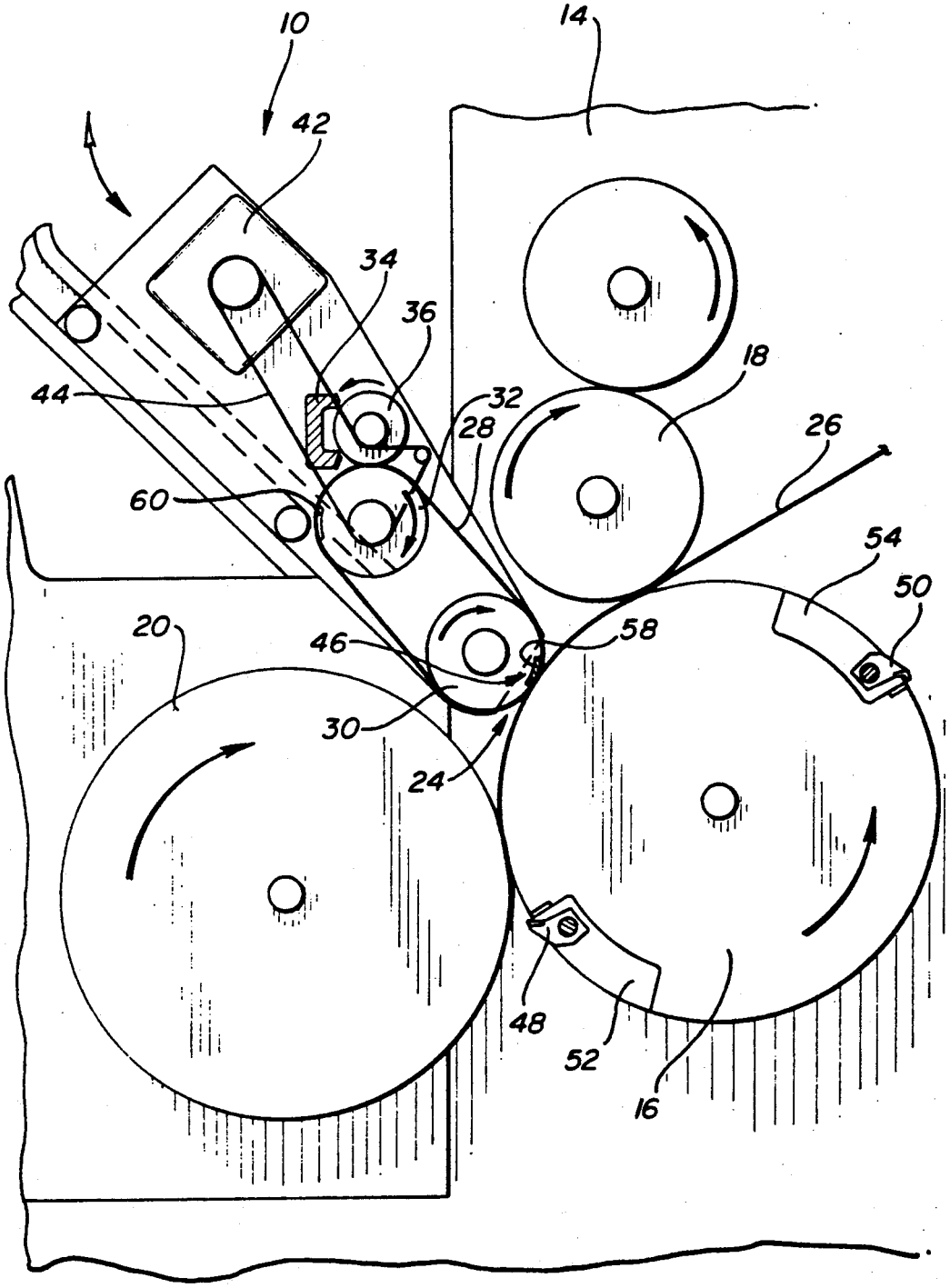
FIG. 2 is a side elevational view of the coating apparatus of FIG. 1 wherein the coating plate belt is shown at a different point in its rotation about the driveable support means.
Figure 3:
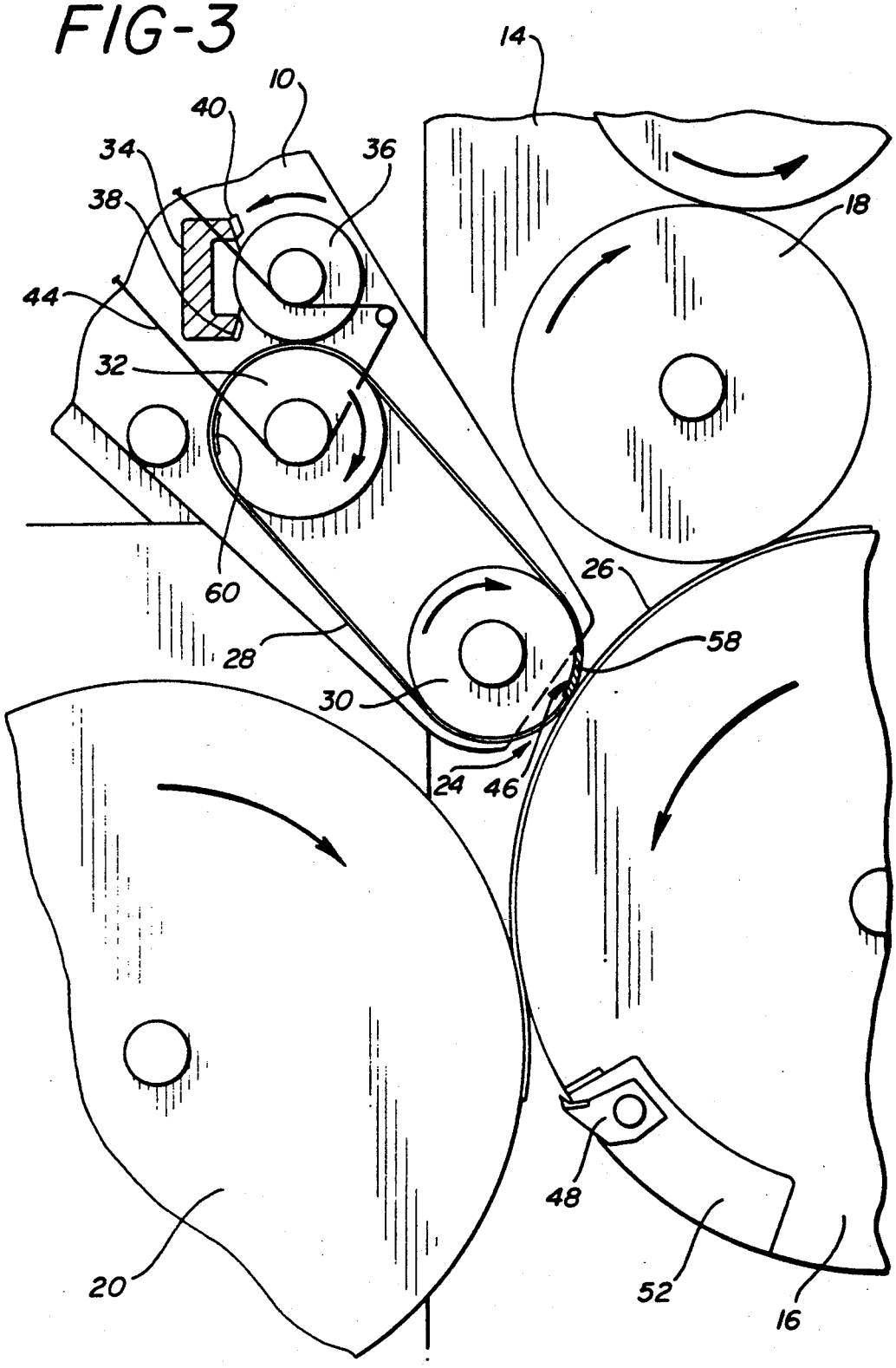
FIG. 3 is a side elevational view of the coating apparatus shown in FIG. 2 enlarged to show the nip site present between the coating apparatus and the printing press.

In particular, pressure roller 30 includes a notch or recessed area 46 formed or cut into its surface as shown in FIGS. 1–3. Recessed area 46 should have sufficient dimensions to accommodate the height of gripper 48 and gripper 50 as they pass through the nip site 24.

In sheet-fed printing presses, individual workpieces travel through the press, one sheet at a time. Consequently, press cylinders employed in these presses have "grippers" positioned at various points along their surfaces in order to transfer and guide the individual sheets from cylinder to cylinder. Generally, grippers function by grabbing and retaining the leading edge of an individual sheet until the sheet is subsequently passed to an adjacent cylinder. Each gripper has a series of finger-like projections extending outwardly from and positioned longitudinally along the body of the gripper to perform the "grabbing" and "retaining" function.

A gripper is typically positioned in a cylinder gap or trough so that it does not create an obstruction when the cylinder rotates the gripper into contact with an adjacent cylinder. For example, in FIGS. 1–3, grippers 48 and 50 are shown residing in cylinder gaps 52 and 54, respectively. Although most of the gripper body resides in the recessed cylinder gap, a portion of the gripper fingers extending from each gripper must protrude slightly above the surface of the cylinder on which the gripper is positioned in order to effectively "grab" the leading edge of the sheet. Consequently, there must be a notch or recessed area residing somewhere along a portion of the surface of any cylinder which abuts another cylinder having a gripper. This notch or recessed area must be of sufficient depth to accommodate that portion of the gripper protruding above the surface of the cylinder on which it resides Generally, impression and transfer cylinders of sheet-fed printing presses are equipped with grippers while any blanket and/or other cylinders which abut impression or other cylinders having grippers include recessed areas in their surfaces to accommodate the grippers.

Referring to FIGS. 1–3, coating plate belt 28 is shown passing between pressure roller 30 and press cylinder 16 in order to transfer the liquid coating fluid to workpiece 26 as it passes through the nip site 24. Referring briefly to FIG. 4, coating plate belt 28 includes gripper slots 56 formed through the thickness of the belt and positioned across the width of the belt. When coating belt 28 is initially mounted about rollers 30 and 32, it should be oriented so as to align the gripper slots 56 over the recessed area 46 of the pressure roller 30.

Furthermore, the orientation of the coating plate belt about rollers 30 and 32 should be such that the gripper slots 56 are aligned over recessed area 46 at a preselected angular rotational position of pressure roller 30. More particularly, gripper slots 56 should pass through nip site 24 simultaneously and in alignment with recessed area 46 so as to accommodate the height of grippers 48 and 50. Consequently, gripper slots 56 should be of sufficient number and should have dimensions for accommodating the gripper-fingers (not shown) of grippers 48 and 50. Insufficient slot size or misalignment of the slots and recessed area 46 may damage the coating plate belt or the grippers.

In addition to providing for an alignment of gripper slots 56 with recessed area 46 on pressure roller 30 in order to accommodate any grippers which may be present on press cylinder 16, coating plate belt 28 must be sized in accordance with the press cylinder to which it abuts to form a nip when the coating apparatus is being used in conjunction with a sheet-fed press or during spot-coating operations performed on either a sheet-fed or web-fed press.

For example, in a sheet-fed printing press, individual sheets are transferred from press cylinder to press cylinder as they move through the press. As previously mentioned, these individual sheets or workpieces are often retained on the surface of these cylinders by grippers which grab the leading edge of the workpiece. The number of sheets that can be retained on the surface of any one cylinder at any one instant in time depends upon the number of grippers available on the cylinder, the circumferential diameter available on the cylinder surface against which the sheets are supported and the length of the individual sheets. Cylinder gaps recessed in the surface of these cylinders for housing the grippers do not provide for a supporting surface against which a workpiece can rest and consequently result in what is referred to as "dead space" on the cylinder surface.

For example, the area of a press cylinder surface between the trailing edge of one workpiece and the leading edge of another workpiece would constitute "dead space". Obviously, in coating operations where the coating apparatus is contacting a press cylinder to deliver coating fluid to a workpiece, it would be undesirable to have the coating plate belt deliver coating fluid to the nip when there is no workpiece present to receive the coating fluid.

Consequently, when the coating apparatus of the present invention is used in conjunction with a sheet-fed printing press or in spot coating operations, the coating plate belt must be sized in order to accommodate individual sheet length as well as individual sheet width. Additionally, the belt length must also include "no print" areas where coating fluid is absent from the belt. These "no print" areas must be coordinated with "dead space" present on the press cylinder.

Accordingly, the length of the coating plate belt of the present invention is either equivalent to or an inverse multiple of the circumferential measurement of the press cylinder to which it abuts. For example, in the preferred embodiment of the present invention, coating plate belt 28 has a length which is one half the circumferential measurement of press cylinder 16. Consequently, for every complete rotation of press cylinder 16, coating belt 28 makes two complete revolutions around rollers 30 and 32.

Alternatively, in overall coating or full-coverage coating operations performed on a web-fed press, a continuous web of material receives a uniform, unbroken application of coating fluid. Consequently, if the present invention were to be employed in such a procedure, considerations regarding belt length and the strategic positioning of "no print" regions along the length of the belt would be of minor concern.

Referring to FIG. 1, workpiece 26 is shown with its leading edge held in position at nip site 24 by gripper 48. Recessed area 46 is present at the nip site to accommodate the portion of gripper 48 which extends above the surface of press cylinder 16. As previously mentioned, it is necessary to have the recessed area 46 positioned in the nip site simultaneously with the gripper in order to prevent damage to the equipment.

Additionally, the circumferential measurement of pressure roller 30 must be an inverse multiple of the circumferential measurement of press cylinder 16. By way of illustration, if pressure roller 30 has a circumferential measurement equivalent to the circumferential measurement of press cylinder 16, pressure roller 30 would require a number of recessed areas on its surface equal to the number of grippers on press cylinder 16. Furthermore, each of the recessed areas must be of sufficient depth to accommodate that portion of each gripper finger which extends from the body of each gripper and protrudes above the press cylinder surface.

Such a situation would be impossible however, due to the presence of press cylinders 18 and 20, which severely limit accessibility to the surface of press cylinder 16. Consequently, the circumferential measurement of pressure roller 30 cannot be equivalent to the circumferential measurement of press cylinder 16, but rather must be sufficiently reduced in order to access the cylinder surface.

Since pressure roller 30 will have a smaller circumferential measurement than press cylinder 16, it will rotate a number of times for every single rotation of press cylinder 16 in order to maintain the same surface speed. If press cylinder 16 has grippers present on its surface, pressure roller 30 will have to have a circumferential measurement which is an inverse multiple of the circumferential measurement of press cylinder 16 in order to have recessed area 46 present at nip site 24 when a gripper passes through the nip.

In a typical coating apparatus used in conjunction with a sheet-fed printing press, an applicator roller on the coater transfers the coating fluid to the printing press. In particular, the applicator roller either transfers the coating fluid directly to the workpiece as it moves through the nip site created between a printing press cylinder and the coating apparatus applicator roller or the applicator roller transfers the coating fluid to a blanket cylinder which, in turn, applies the coating fluid to the workpiece.

In either situation, the applicator roller will repeatedly apply coating fluid directly or indirectly to individual worksheets as they pass through the nip. Consequently, the applicator roller must have a circumferential measurement at least equivalent to sheet length in order to ensure image repeatability. Furthermore, the circumferential measurement of the applicator roller must actually be greater than the individual sheet length so that the "dead space" present on the press cylinder surface between the trailing edge of one sheet and the leading edge of the next sheet does not receive any coating fluid.

Due to the spacial constraints present in many printing press arrangements, a coating apparatus having an applicator roller conforming to even these minimal circumferential measurement parameters has a diameter which precludes it from abutting the desired press cylinder within the printing press in order to deliver a liquid coating fluid to a workpiece traveling thereon.

Consequently, in the preferred embodiment of the present invention, the coating plate belt 28 should be of sufficient length to accommodate a coating surface equivalent to the individual sheet length of workpiece 26 plus any additional length needed to provide for a "no print" region corresponding to the "dead space" on the press cylinder.

In short, the length of coating plate belt 28 should be proportional to the circumferential measurement of press cylinder 16. As previously mentioned, these considerations apply when the present invention is being used in conjunction with a sheet-fed press or in a spot coating procedure done on either a sheet-fed or web-fed press. For spot coating procedures performed on a web-fed press, the belt length must be sized so as to incorporate "no print" regions despite the fact that no grippers or cylinder gaps are present. In contrast, overall coating procedures performed on a web-fed press do not require that the length of the coating plate belt be sized to account for the presence of "no print" regions since the coating fluid is continuously being applied.

The diameter of pressure roller 30 should be sufficiently reduced so as to afford clearance between press cylinders 18 and 20 while providing for contact of the coating belt with press cylinder 16. As previously mentioned, the circumferential measurement of pressure roller 30 should be an inverse multiple of the circumferential measurement of press cylinder 16 in order to ensure that the recessed area 46 is always present at the nip site whenever a gripper on press cylinder 16 passes through the nip.

In the preferred embodiment of the present invention, pressure roller 30 has, for example, a circumferential measurement which is ¼ the circumferential measurement of press cylinder 16. Consequently, for every complete rotation of press cylinder 16, pressure roller 30 makes four complete revolutions. Furthermore, recessed area 46 passes through nip site 24 four times, twice for every passage of a gripper through the nip. As a result, recessed area 46 only accommodates a gripper at nip site 24 during every other passage through the nip.

For example, referring to FIGS. 2 and 3, recessed area 46 is shown in a position just prior to entering nip site 24. Referring in particular to FIG. 2, grippers 48 and 50 are shown in their respective positions approximately 90° away from the nip site.

As previously explained, coating plate belt 28 must be of a length proportional to the circumferential measurement of press cylinder 16 and pressure roller 30 must be an inverse multiple of the circumferential measurement of press cylinder 16. Consequently, the length of coating plate belt 28 will be proportional to the circumferential measurement of pressure roller 30, by necessity.

This relationship is important. During every other passage of recessed area 46 through nip site 24, coating plate belt 28 is applying coating fluid to workpiece 26, as seen in FIG. 3. In order for the coating fluid to be uniformly applied to the surface of the workpiece, pressure roller 30 must apply sufficient back pressure to coating belt 28 at nip site 24.

In order to maintain this back pressure on the coating belt at the nip site during every other passage of recessed area 46 through the nip, a filler piece or strip 58 is mounted across the width of the coating belt as seen in FIG. 4. The filler piece is mounted on the backside of the coating belt which contacts rollers 30 and 32. Filler piece 58 should have dimensions approximating the dimensions of recessed area 46 so as to cooperatively mate with the recess. Similarly, recessed area 46 should have dimensions which can accommodate filler piece 58.

As previously explained with respect to the preferred embodiment of the present invention, press cylinder 16 makes one complete revolution for every four complete revolutions of pressure roller 30. Furthermore, recessed area 46 will pass through the nip site four times for every complete revolution of press cylinder 16. In two of these passes through the nip site, a gripper on press cylinder 16 will be present at the nip to meet the recessed area. In the other two passes through the nip site, no gripper will be present to meet the recessed area, however, the filler piece on the backside of the coating belt will move into recessed area to provide back pressure for the coating belt which is simultaneously delivering coating fluid to the workpiece in the nip.

Since the filler piece 58 is affixed to the backside of coating plate belt 28, its presence must be accommodated on transfer roller 32 as well. Consequently, transfer roller 32 has a secondary recessed area 60 on its surface. Secondary recessed area 60 also has dimensions which approximate the dimensions of filler piece 58 so as to accommodate the presence of the filler piece when it contacts the roller surface.

Referring to FIG. 4, coating plate belt 28 is shown in a plan view from the backside of the belt. The coating plate belt includes splicing patterns 62 and 64 which consists of cooperating mechanical segments which can interlock with one another in order to position the belt about rollers 30 and 32. The coating plate belt includes printing region 66 and no print region 68. Printing region 66 is available for delivering coating fluid to a workpiece as it passes through the nip site. Accordingly, coating plate belt 28 must be oriented about rollers 30 and 32 in such a fashion as to coordinate the passage of printing region 66 through the nip site with those areas on the surface of press cylinder 16 which do not constitute "dead space". No print region 68 includes gripper slots 56. This region of coating plate belt 28 must similarly be coordinated with the surface of press cylinder 16, however, it should be coordinated so as to pass through the nip site simultaneously with the "dead space" (not shown) present on press cylinder 16.

The coating plate belt of the present invention is interchangeable with other coating belts depending upon the coating operation to be performed. In overall coating operations where the workpiece receives full coverage of the coating fluid, the coating plate belt need only be changed depending upon the dimensions of the workpiece to be covered or the type of coating fluid to be applied. In spot coating operations, however, the coating plate belt should obviously be changed in accordance with designated areas on the workpiece which are to receive the coating fluid.

In operation, anilox roller 36 picks up coating fluid from coating fountain 34. Doctor blades 38 and 40 meter the supply of coating fluid on the anilox roller before the fluid is transferred to coating plate belt 28. Anilox roller 36 subsequently transfers the metered supply of coating fluid to coating plate belt 28 which is driven about rollers 30 and 32. Referring to FIG. 1, a workpiece 26 is shown partially positioned on press cylinder 16 with its leading edge held by gripper 48. Recessed area 46 is present to accommodate gripper 48 and the no print region 68 (not shown) of the belt is present in nip site 24 to correspond with the presence of "dead space" (not shown) on press cylinder 16. Filler piece 58 is shown positioned in contact with transfer roller 32 and residing in secondary recessed area 60.

As the workpiece moves through the nip, printing region 66 (not shown) of plate coating belt 28 applies the coating fluid to workpiece 26 at the nip site. Referring to FIG. 3, workpiece 26 is shown positioned well into the nip. Additionally, recessed area 46 on pressure roller 30 is about to enter the nip site 24. Filler piece 58 is shown residing in recessed area 46 in order to provide sufficient back pressure for coating plate belt 28 which is applying coating fluid (not shown) to the workpiece. Secondary recessed area 60 on transfer cylinder 32 is shown vacant as filler piece 58 is residing in recessed area 46.

While there have been described what are presently believed to be the preferred embodiments of the invention disclosed herein, those skilled in the art will realize that changes and modifications may be made thereto without departing from spirit of the invention, and it is intended to claim all such changes and modifications as fall within the true scope of the invention.

What is claimed is:

1. A liquid coating apparatus capable of operating in conjunction with a printing press having at least one press cylinder, the cylinder rotatably mounted within the press and having at least one gripper mechanism, the apparatus capable of applying a liquid coating fluid to a workpiece traveling over the press cylinder and comprising:

a driveable support means suitable for supporting a belt, the support means including a first and a second roller both rotatably mounted within the apparatus, at least one of the rollers being drivingly coupled to a drive means;

an endless coating plate belt for transferring the liquid coating fluid from the coating apparatus to the workpiece, the endless coating plate being trained about the first and second rollers and driveable by the rollers and supported thereon, the belt including at least three openings distributed transversely across the width of the belt;

drive means for driving the support means, thereby causing the endless coating plate belt to be driven about the first and second rollers;

supply means for supplying the liquid coating fluid to the endless coating plate belt; and metering means for metering the supply of liquid coating fluid supplied to the endless coating plate belt.

2. The liquid coating apparatus according to claim 1, wherein the first roller includes at least one recessed area present on the surface of the first roller and wherein the at least three openings are gripper slots formed through the thickness of the endless coating plate belt, the gripper slots being positionally aligned over the recessed area on the surface of the first roller at a selected angular rotational position of the first roller.

3. The liquid coating apparatus according to claim 2, wherein the endless coating plate belt includes a filler piece having dimensions approximating the dimensions of the recessed area on the surface of the first roller, the filler piece being oriented on the endless coating plate belt so as to afford a cooperative communication of the filler piece with the recessed area on the surface of the first roller upon contact of the filler piece with the first roller and wherein the second roller includes a recessed area on its surface having suitable dimensions for accommodation of the filler piece in a cooperative relationship upon contact of the filler piece with the second roller.

4. The liquid coating apparatus according to claim 2, wherein the first roller has a circumferential measurement which is an inverse multiple of the circumferential measurement of the press cylinder.

5. The liquid coating apparatus according to claim 4, wherein the first roller has a circumferential measurement which is one-fourth the circumferential of the press cylinder.

6. The liquid coating apparatus according to claim 1, wherein the endless coating plate belt has a length equivalent to the circumferential measurement of the press cylinder.

7. The liquid coating apparatus according to claim 1, wherein the endless coating plate belt has a length which is an inverse multiple of the circumferential measurement of the press cylinder.

8. The liquid coating apparatus according to claim 7, wherein the endless coating plate belt has a length which is one-half the circumferential measurement of the press cylinder.

9. An assembly including a printing press, a coating apparatus capable of operating in conjunction with the printing press and means for moving the coating apparatus into an adjoining relationship with the press so as to form a nip site through which workpieces can travel, the printing press having at least one press cylinder rotatably mounted within the press, the coating apparatus being capable of applying a liquid coating fluid to a workpiece traveling over the press cylinder, the coating apparatus comprising:

a driveable support means suitable for supporting a belt, the support means including a first and a second roller both rotatably mounted within the apparatus, at least one of the rollers being drivingly coupled to a drive means;

an endless coating plate belt for transferring the liquid coating fluid from the coating apparatus to the workpiece at the nip site, the endless coating plate belt being trained about the first and second rollers and driveable by the rollers and supported thereon, the belt including at least one opening formed therein, the opening configured and dimensioned to accommodate passage of the gripper mechanism therethrough;

drive means for driving the support means, thereby causing the endless coating plate belt to be driven about the first and second rollers;

supply means for supplying the liquid coating fluid to the endless coating plate belt; and metering means for metering the supply of liquid coating fluid supplied to the endless coating plate belt.

10. The assembly according to claim 9, wherein the first roller includes at least one recessed area present on the surface of the first roller and wherein the at least one opening is a gripper slot formed through the thickness of the endless coating plate belt, the gripper slot being positionally aligned over the recessed area on the surface of the first roller at a selected angular rotational position of the roller.

11. The assembly according to claim 10, wherein the endless coating plate belt of the coating apparatus includes a filler piece having dimensions approximating the dimensions of the recessed area on the surface of the first roller, the filler piece being oriented on the endless coating plate belt so as to afford a cooperative communication of the filler piece with the recessed area on the surface of the first roller upon contact of the filler piece with the first roller and wherein the second roller includes a recessed area on its surface having suitable dimensions for accommodation of the filler piece in a cooperative relationship upon contact of the filler piece with the second roller.

12. The assembly according to claim 10, wherein the first roller has a circumferentially measurement which is an inverse multiple of the circumferential measurement of the press cylinder.

13. The assembly according to claim 12, wherein the first roller has a circumferential measurement which is one fourth the circumferential measurement of the press cylinder.

14. The assembly according to claim 9, wherein the endless coating plate belt of the coating apparatus has a length equivalent to the circumferential measurement of the press cylinder.

15. The assembly according to claim 9, wherein the endless coating plate belt of the coating apparatus has a length which is an inverse multiple of the circumferential measurement of the press cylinder.

16. The assembly according to claim 15, wherein the endless coating plate belt of the coating apparatus has a length which is one half the circumferential measurement of the press cylinder.

* * * * *

UNITED STATES PATENT AND TRADEMARK OFFICE

CERTIFICATE OF CORRECTION

PATENT NO. : 5,209,179

DATED : May 11, 1993

INVENTOR(S) : John C. Herbert and Frank A. Andaloro

It is certified that error appears in the above-identified patent and that said Letters Patent is hereby corrected as shown below:

At Column 9, line 27, after "plate", insert --belt--.

At Column 10, line 68, before "measurement", delete "circumferentially", insert --circumferential--.

Signed and Sealed this

Eleventh Day of January, 1994

Bruce Lehman

*Attest:*

BRUCE LEHMAN

*Attesting Officer*

*Commissioner of Patents and Trademarks*